US009843859B2

(12) United States Patent
Tan et al.

(10) Patent No.: US 9,843,859 B2
(45) Date of Patent: Dec. 12, 2017

(54) METHOD FOR PREPROCESSING SPEECH FOR DIGITAL AUDIO QUALITY IMPROVEMENT

(71) Applicant: MOTOROLA SOLUTIONS, INC., Schaumburg, IL (US)

(72) Inventors: Cheah Heng Tan, Penang (MY); Linus Francis, Kedah (MY); Robert J. Novorita, Orland Park, IL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 295 days.

(21) Appl. No.: 14/724,375

(22) Filed: May 28, 2015

(65) Prior Publication Data

US 2016/0351203 A1 Dec. 1, 2016

(51) Int. Cl.

| | |
|---|---|
| ***G10L 21/00*** | (2013.01) |
| ***H04R 1/46*** | (2006.01) |
| ***G10L 21/0364*** | (2013.01) |
| ***H04R 1/10*** | (2006.01) |
| *G10L 21/02* | (2013.01) |
| *G10L 19/26* | (2013.01) |
| *H04R 3/00* | (2006.01) |

(52) U.S. Cl.

CPC ..... *H04R 1/46* (2013.01); *G10L 21/0364* (2013.01); *H04R 1/1016* (2013.01); *G10L 19/265* (2013.01); *H04R 3/005* (2013.01); *H04R 2460/13* (2013.01)

(58) Field of Classification Search

CPC ..... G10L 21/0364; G10L 19/265; H04R 1/46; H04R 1/1016; H04R 2460/13; H04R 3/005

USPC ..... 704/205, 206, 227, 228, 268

See application file for complete search history.

(56) References Cited

U.S. PATENT DOCUMENTS

| | | | | |
|---|---|---|---|---|
| 5,060,270 | A | 10/1991 | Shinoda | |
| 5,692,059 | A | 11/1997 | Kruger | |
| 5,982,903 | A | 11/1999 | Kinoshita et al. | |
| 6,240,384 | B1 * | 5/2001 | Kagoshima | G10L 13/07 704/220 |

(Continued)

FOREIGN PATENT DOCUMENTS

| | | |
|---|---|---|
| AU | 2005262623 | 1/2006 |
| EP | 2611218 | 7/2013 |

(Continued)

*Primary Examiner* — Thierry L Pham

(74) *Attorney, Agent, or Firm* — Michael Best & Friedrich LLP

(57) ABSTRACT

Preprocessing speech signals from an indirect conduction microphone. One exemplary method preprocesses the speech signal in two stages. In stage one, an external speech sample is characterized using an auto regression model, and coefficients from the model are convolved with the internal speech signal from the indirect conduction microphone to produce a pre-conditioned internal speech signal. In stage two, a training sound is received by the indirect conduction microphone and filtered through a low-pass filter. The result is then modeled using auto regression, and inverted to produce an inverted filter model. The pre-conditioned internal speech signal is convolved with the inverted filter model to remove negative or undesirable acoustic characteristics and loss from the speech signal from the indirect conduction microphone.

16 Claims, 4 Drawing Sheets

(56) References Cited

U.S. PATENT DOCUMENTS

| | | | | |
|---|---|---|---|---|
| 8,005,228 | B2 | 8/2011 | Bhartikar et al. | |
| 2009/0097681 | A1 | 4/2009 | Puria et al. | |
| 2009/0208027 | A1 | 8/2009 | Fukuda et al. | |
| 2009/0220096 | A1 | 9/2009 | Usher et al. | |
| 2014/0023217 | A1 | 1/2014 | Zhang | |
| 2015/0168996 | A1* | 6/2015 | Sharpe | G06F 21/316 700/73 |

FOREIGN PATENT DOCUMENTS

| | | |
|---|---|---|
| EP | 2680608 | 1/2014 |
| WO | 2011056856 | 5/2011 |

* cited by examiner

METHOD FOR PREPROCESSING SPEECH FOR DIGITAL AUDIO QUALITY IMPROVEMENT

BACKGROUND OF THE INVENTION

Microphones convert sounds to electrical signals and are used with a variety of devices where voice communication or voice control is desired. For example, microphones may be used in or with mobile telephones, two-way radios, personal audio devices, computers, and the like. In some cases, the microphone is part of a headset that includes, for example, speakers or other transducers for reproducing sound. In such cases, the speakers within the headset are positioned close to a user's ears. The microphone may be positioned on a boom or arm of the headset which is designed to be located at or near the user's mouth. In other cases, the microphone is not on a boom or arm. Instead the microphone is positioned within the ear canal and is connected to or included within an earphone or ear bud. Such a microphone is referred to as an in-ear microphone or "ear microphone" and eliminates the need for an arm to position the microphone near the user's mouth. An ear microphone receives speech sound from the user's mouth after the sound has propagated through the user's bones and tissue to the ear canal. The ear microphone generates a speech signal which may, for example, be encoded in a first communication device and then transmitted from the first communication device to another or second communication device. The second communication device receives the encoded signal and then decodes that signal. When a speech signal of poor speech quality is encoded at the first communication device, the decoded speech output at the second communication device can be unintelligible. A poor speech signal can be caused by, among other things, improper placement of the ear microphone in the ear canal and reverberations within the ear canal. The speech signal may also be degraded due to the combined effects on the user's voice as it propagates through the several biological media within the body, i.e., the bone and various tissues located between the mouth and the ear canal. Improving the speech signal prior to encoding (at the first communication device) could lead to improved decoded speech output (at the second communication device), which is therefore more intelligible.

Accordingly, there is a need for a method for preprocessing speech for digital audio quality improvement.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
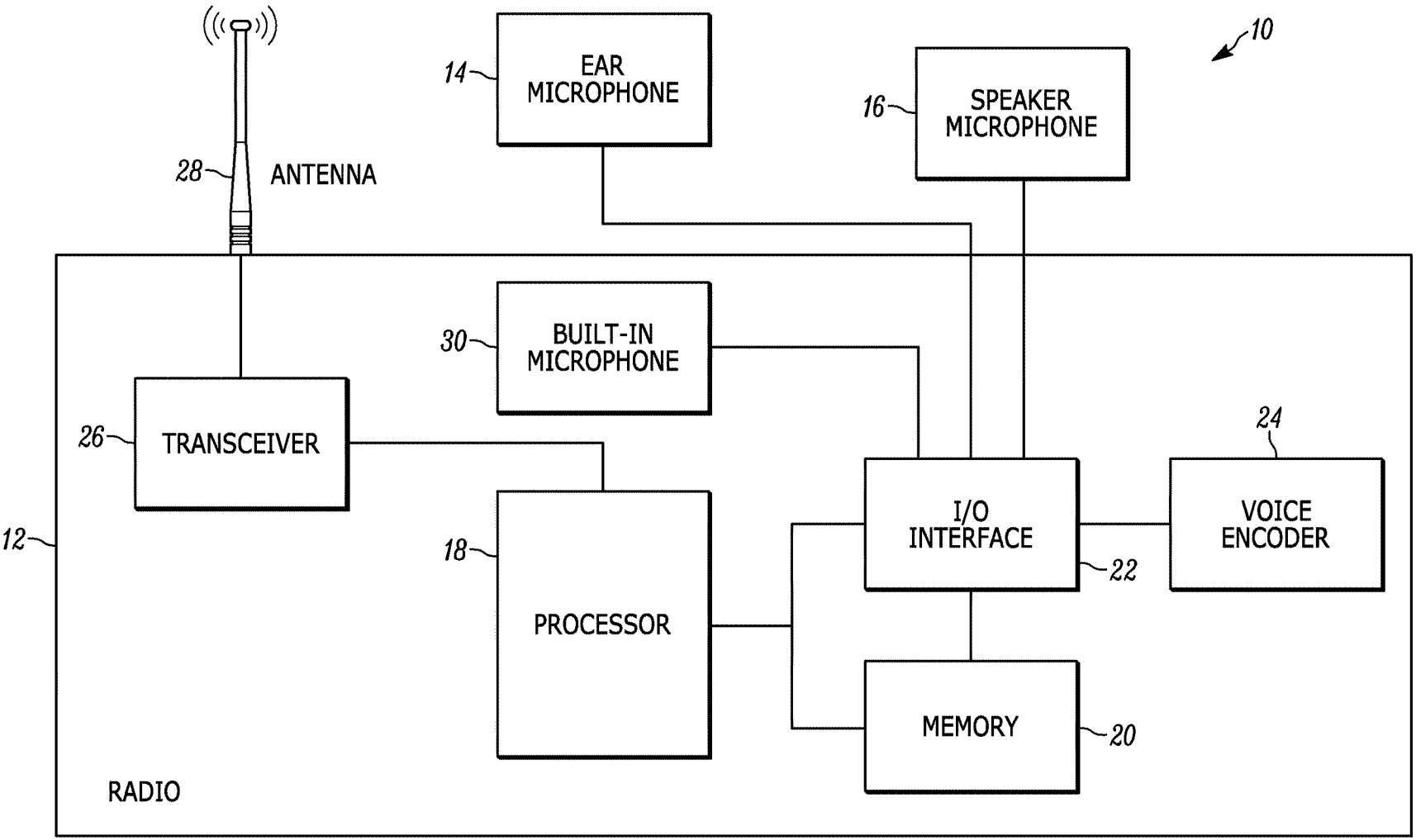
FIG. 1 is a schematic illustration of a communication device connected to an ear microphone and a speaker microphone.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Some exemplary embodiments of the invention include a method for preprocessing speech signals received from an indirect conduction microphone. In one embodiment, the method includes receiving an external speech sound with a direct conduction microphone. The method further includes estimating an external speech spectral model, including a plurality of coefficients, based on the external speech sound. The method further includes receiving an internal speech signal from the indirect conduction microphone. The method further includes combining the plurality of coefficients with the internal speech signal to produce a preconditioned internal speech signal. The method further includes obtaining a low-frequency training sound signal, and estimating a filter model characteristic based on the low-frequency training sound signal. The method further includes determining an inverted filter model characteristic, and combining the inverted filter model characteristic with the preconditioned internal speech signal to produce a preprocessed internal speech signal.

FIG. 1 schematically illustrates a communication device 10. Embodiments of the invention are described in connection with the communication device 10. However, the microphones and speech processing techniques described herein may be used with other types of devices not just the exemplary communication device 10 described and illustrated.

The communication device 10 includes a radio 12 and an ear microphone 14. In some embodiments, the communication device 10 also includes a speaker microphone 16. The radio 12 includes a processing unit 18 (e.g., a microprocessor, application specific integrated circuit, etc.), a memory 20, an input/output interface 22, a voice encoder 24, a transceiver 26, an antenna 28, and a built-in microphone 30. The processing unit 18 is connected to the memory 20, the input/output interface 22, the voice encoder 24, and the transceiver 26. The ear microphone 14, the speaker microphone 16, and the built-in microphone 30 are all capable of sensing sound, converting the sound to electrical signals, and transmitting the electrical signals to the processing unit 18 via the input/output interface 22. Direct conduction microphones, for example, the built-in microphone 30 and the speaker microphone 16 sense sound conducted through air. Indirect conduction microphones, for example, the ear microphone 14, sense sound conducted partially or wholly through bone and other body tissue. While the systems and methods described herein are described particularly in relation to the ear microphone 14, it should be noted that they may also be suitable for preprocessing speech signals produced by other indirect conduction microphones, for example, skull microphones and throat microphones.

The processing unit 18 processes the electrical signals received from the ear microphone 14, the speaker microphone 16, and the built-in microphone 30 via the input/output interface 22. The processing unit 18 is connected to the voice encoder 24 via the input/output interface 22, and provides the processed and unprocessed electrical signals to the voice encoder 24 through the input/output interface 22. The voice encoder 24 encodes the electrical signals and produces a digital output for transmission by the radio 12 to other radio devices. The voice encoder 24 provides the digital output to the processing unit 18 via the input/output interface 22. The transceiver 26 transmits and receives radio signals using antenna 28. The processing unit 18, the voice encoder 24, and the transceiver 26 may include various digital and analog components, which for brevity are not described herein and which may be implemented in hardware, software, or a combination of both.

The memory 20 can include one or more non-transitory computer-readable media, and includes a program storage area and a data storage area. The program storage area and the data storage area can include combinations of different types of memory, as described herein.

The processing unit 18 obtains and provides information (e.g., from the memory 20 and/or the input/output interface 22), and processes the information by executing one or more software instructions or modules, capable of being stored, for example, in a random access memory ("RAM") area of the memory 20 (e.g., during execution) or a read only memory ("ROM") of the memory 20 (e.g., on a generally permanent basis) or another non-transitory computer readable medium. The software can include firmware, one or more applications, program data, filters, rules, one or more program modules, and other executable instructions. The processing unit 18 is configured to retrieve from the memory 20 and execute, among other things, software related to the control processes and methods described herein. The input/output interface 22 obtains information and signals from, and provides information and signals to, (e.g., over one or more wired and/or wireless connections) devices both internal and external to the radio 12. The processing unit 18, the memory 20, and the input/output interface 22, as well as the other various modules are connected by one or more control or data buses. The use of control and data buses for the interconnection between and exchange of information among the various modules and components would be apparent to a person skilled in the art in view of the description provided herein. It should be understood that although only a single processing unit 18, input/output interface 22, and memory 20 are illustrated in FIG. 1, the communication device 10 can include multiple processing units, memory modules, and/or input/output interfaces.

Figure 2:
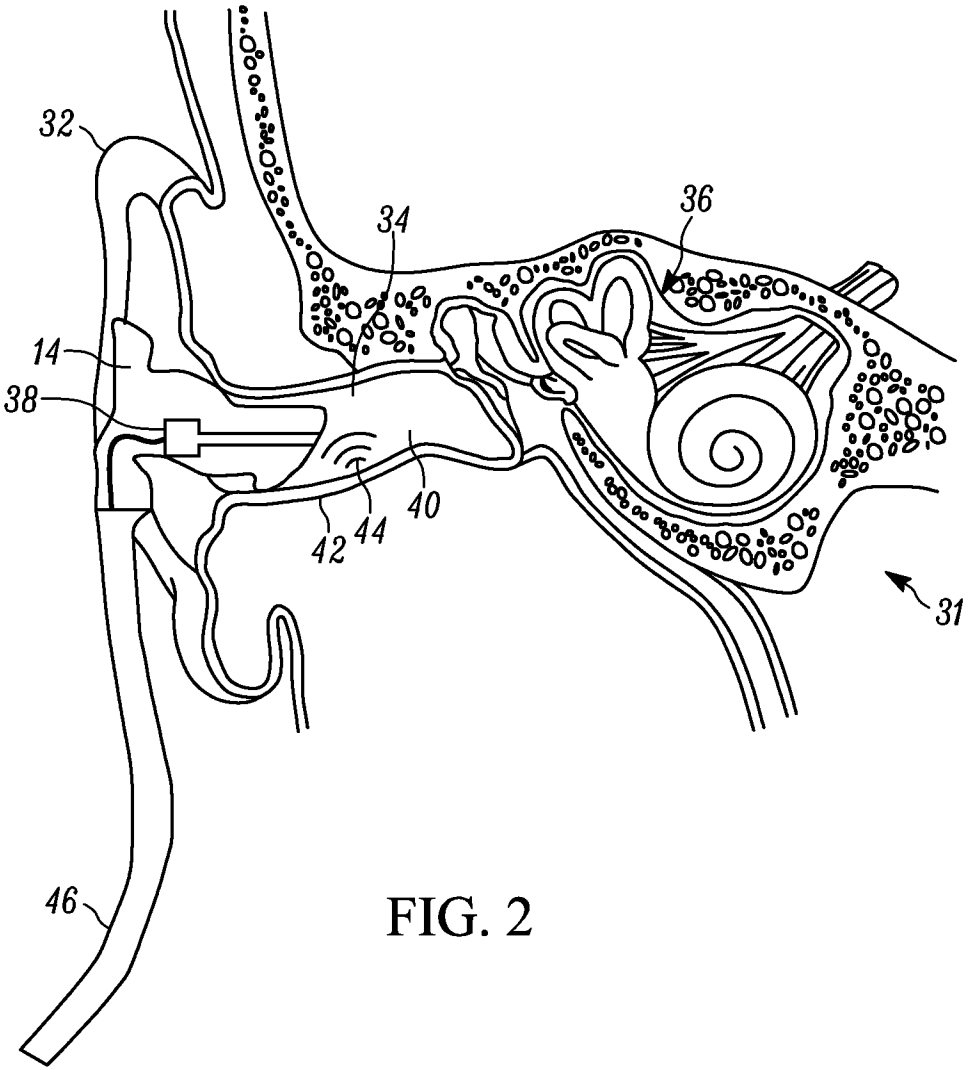
FIG. 2 illustrates the ear microphone of FIG. 1 in accordance with some embodiments.

FIG. 2 illustrates the ear microphone 14 positioned in an ear 31 of a user. The ear 31 includes an outer ear 32, an ear canal 34, and an inner ear 36. The ear microphone 14 includes a microphone element 38, which is positioned to face the inner ear 36 when the ear microphone 14 is inserted in the ear canal 34. To use the ear microphone 14, it is positioned in the ear canal 34. The ear microphone 14 forms a seal with the ear canal 34, forming a chamber 40, which is acoustically isolated from the ambient noise in the user's environment. When the user speaks, sound radiates from the user's mouth, producing external speech sounds. Internal speech sounds are produced when some of the sound from the user's external speech propagates internally through multiple biological media, i.e., the flesh and bone of the user's head, each with its own acoustic propagation characteristics. This propagation through multiple biological media creates a composite signal, which causes the ear canal wall 42 to vibrate. This vibration produces a sound 44, in the ear canal, which is received by the microphone element 38. Microphone element 38 is capable producing electrical signals in response to the sound 44, and communicating the electrical signals to the processing unit 18 via the cable 46.

Three factors negatively affect the quality of the output signal, produced by the radio 12, containing audio information representing the sound sensed by the ear microphone 14. First, the sound 44 experiences loss as it travels from the mouth, through bone and other tissue, to the ear canal wall 42. Second, the multiple biological propagation media induce frequency-selective attenuation and phase group delay characteristics particular to each propagation medium. Third, the sound 44 produces reverberations in the chamber 40.

Figure 3:
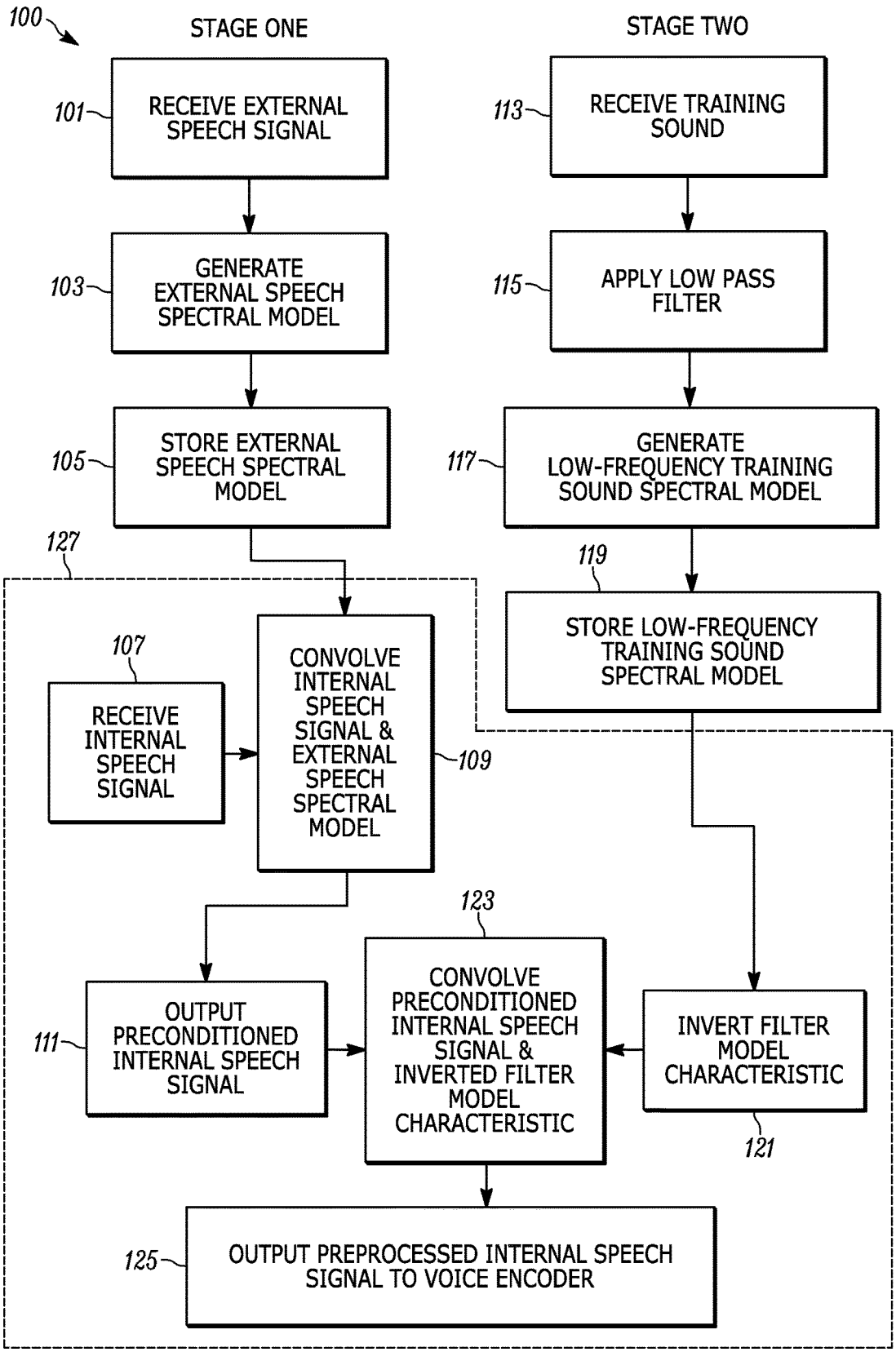
FIG. 3 is a flowchart of a method of pre-processing speech for digital audio quality enhancement in accordance with some embodiments.

FIG. 3 illustrates an exemplary method 100, which the processing unit 18 can use to preprocess the internal speech signal produced by ear microphone 14. This preprocessing reduces the effects of the loss and reverberation before the internal speech signals are digitally encoded by the voice encoder 24. In the example illustrated, the method includes two stages. As will be explained in greater detail below, the first stage, preconditions the internal speech signals by enhancing the signal so it better approximates an external speech signal. The second stage further enhances the internal speech signals by subtracting the effects of the reverberation and the loss generated when the external speech propagates internally to the ear canal 34.

Stage one begins at block 101, where the processing unit 18 receives a sample of external speech produced by the user using an external microphone, i.e., a microphone other than the ear microphone 14. External speech (i.e., speech sensed via direct conduction) has higher audio quality compared to internal speech (i.e., speech sensed via indirect conduction). In some embodiments, the external microphone is the speaker microphone 16. In other embodiments, the external microphone is the built-in microphone 30 of the communication device 10. In some embodiments, the processing unit 18 can select to use either the speaker microphone 16 or the built-in microphone 30, or use both. In some embodiments, the communication device 10 prompts the user to produce an external speech sample. In other embodiments, the processing unit 18 takes an external speech sample at a suitable point during radio transmission of voice signals by the user. For example, while the user is making a voice transmission using the communication device 10, the processing unit 18 may activate the built-in microphone 30 to take an external speech sample.

In block 103, the processing unit 18 uses an autoregressive filter to estimate a spectral model for the external speech sample. The external speech spectral model includes coefficients, which characterize the external speech.

In block 105, processing unit 18 stores the external speech spectral model in the memory 20. Once the external speech spectral model is stored, it can be used continuously. In some embodiments, the external speech spectral model is updated periodically. In other embodiments, the external speech spectral model is updated in response to a prompt from the user, or from a remote system. Blocks 101-105 prepare the external speech spectral model, which will be used to preconditions the internal speech signal received in block 107. This will enhance the internal speech signal by supplying it with the high-frequency components that were attenuated during transmission through the biological propagation media. The resulting preconditioned internal speech signal will better approximate an external speech signal. As described more particularly below, this will, when combined with stage two, produce a preprocessed internal speech signal that is an improvement over the original internal speech signal in both the high and low frequencies.

In block 107, the processing unit 18 receives the internal speech signal from the ear microphone 14. The internal speech signal is produced when the user speaks during routine usage of the communication device 10, for example, when the communication device 10 is a two-way radio, and the user wishes to transmit a voice message to another user using a second two-way radio. In block 109, the processing unit 18 preconditions the internal speech signal by mathematically convolving the internal speech signal with the external speech spectral model. The convolution in block 109 preconditions the internal speech signal to produce a preconditioned internal speech signal. The processing unit 18 outputs the preconditioned internal speech signal in block 111.

Stage two begins with the processing unit 18 receiving a training sound produced by the user of the ear microphone 14. For example, the user can produce the training sound by making a low, continuous sound with the mouth closed, i.e., by humming. The training sound serves as a wide-band forcing function to estimate the transfer function of the acoustic path through the bone and tissue between the mouth and the ear canal 34. The training sound is also used to capture the characteristics of the ear canal 34 acoustics, e.g., the reverberation. In some embodiments, the communication device 10 prompts the user to produce the training sound. In other embodiments, the user prompts the communication device 10 that the user will be producing a training sound.

In block 115, a low-pass filter is applied to the training sound signal to obtain a low-frequency training sound signal. The low-frequency training sound signal captures effects of the loss generated when the external speech propagates internally to the ear canal 34.

In block 117, the processing unit 18 uses an autoregressive filter to create a spectral model for the low-frequency training sound signal. The low-frequency training sound spectral model includes a filter model characteristic. In block 119, processing unit 18 stores the low-frequency training sound spectral model in the memory 20. Once the low-frequency training sound model is stored, it can be used continuously.

In some embodiments, the processing unit 18 causes the ear microphone 14 to artificially generate the internal excitation signal in lieu of the user-generated training sound. The excitation signal can be used by method 100 to mitigate the effects of the reverberation of the chamber 40, but not the effects of the loss.

In block 121, the processing unit 18 inverts the filter model characteristic to produce an inverted filter model characteristic. As described more particularly below, the inverted filter model is beneficially used to mitigate the reverberation, by removing excess low-frequency components (caused by the reverberation) still present in the preconditioned internal speech signal. This will further enhance the internal speech signal, producing a preprocessed internal speech signal that is an improvement over the original internal speech signal in both the high and low frequencies.

In block 123, the processing unit 18 receives the preconditioned internal speech signal produced in block 111, and mathematically convolves, or combines, it with the inverted filter model characteristic produced in block 121. By combining the preconditioned internal speech signal with the inverted filter model characteristic, the convolution in block 123 subtracts the effects of the reverberation and the loss to produce a preprocessed internal speech signal. The processing unit 18 outputs the preprocessed internal speech signal to the voice encoder 24 in block 125.

As noted above, the external speech spectral model created in block 103 can be continuously used by the processing unit 18 in block 109 to precondition the internal speech signal. Similarly, the low-frequency training sound spectral model created in block 117 can be used continuously by the processing unit 18 in blocks 121 and 123 to enhance the preconditioned internal speech signal. Accordingly, embodiments of the invention utilize method 100 by performing blocks 101-105 and 113-119 once to generate the external speech and low-frequency training sound spectral models, and continuously perform blocks 107-125 (indicated by the area 127 bounded by the dashed line in FIG. 3) to produce a preprocessed internal speech signal input to the voice encoder 24. The continuously performed blocks of method 100 are performed during transmission, when the user's speech causes the ear microphone 14 to generate a speech signal.

Figure 4:
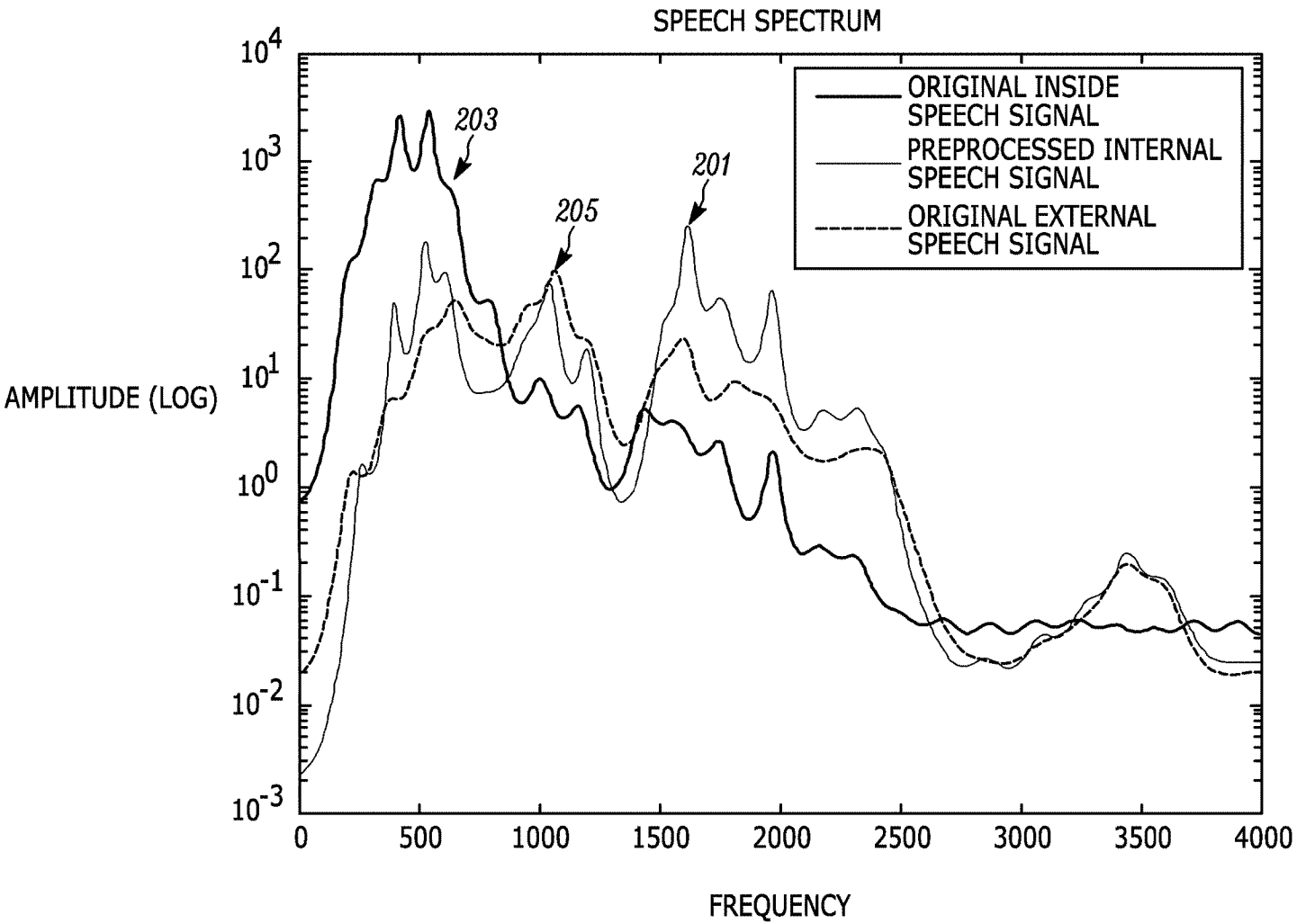
FIG. 4 is a chart illustrating a speech spectrum produced using the method of FIG. 3.

FIG. 4 is a chart illustrating experimental results of using the method 100 to preprocess speech signals. The chart illustrates the spectral characteristics of the preprocessed internal speech (line 201), compared to the original internal speech (line 203), and the original external speech (line 205). The spectral characteristic curves for the preprocessed internal speech and the external speech are similar. This demonstrates how the method 100, when applied to the internal speech, produces a preprocessed speech signal that is closer in form to the external speech.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A method for preprocessing speech signals received from an indirect conduction microphone, the method comprising:

receiving, by a direct conduction microphone, an external speech sound;

estimating, by a processor, an external speech spectral model based on the external speech sound, the external speech spectral model including a plurality of coefficients;

receiving, from the indirect conduction microphone, an internal speech signal;

combining, by the processor, the plurality of coefficients with the internal speech signal to produce a preconditioned internal speech signal;

obtaining, by the processor, a low-frequency training sound signal;

estimating, by the processor, a filter model characteristic based on the low-frequency training sound signal;

determining, by the processor, an inverted filter model characteristic; and combining, by the processor, the inverted filter model characteristic with the preconditioned internal speech signal to produce a preprocessed internal speech signal.

2. The method of claim 1, further comprising:

receiving, by the indirect conduction microphone, a training sound; and filtering, by the processor, the training sound to produce a low-frequency training sound signal.

3. The method of claim 2, wherein the training sound is produced by a user of the indirect conduction microphone.

4. The method of claim 2, wherein the training sound is an internal excitation produced by the indirect conduction microphone.

5. The method of claim 1, further comprising:

receiving, by a voice encoder, the preprocessed internal speech signal; and digitizing, by the voice encoder, the preprocessed internal speech signal.

6. The method of claim 1, wherein the indirect conduction microphone is an ear microphone.

7. The method of claim 1, wherein the indirect conduction microphone is a throat microphone.

8. The method of claim 1, wherein the indirect conduction microphone is a skull microphone.

9. A communications device, the device comprising:

a direct conduction microphone, an indirect conduction microphone, and a radio, including a memory, and a processor configured to receive, from the direct conduction microphone, an external speech signal;

estimate an external speech spectral model, based on the external speech signal, the external speech spectral model including a plurality of coefficients;

receive, from the indirect conduction microphone, an internal speech signal;

combine the plurality of coefficients with the internal speech signal to produce a preconditioned internal speech signal;

obtain a low-frequency training sound signal;

estimate a filter model characteristic based on the low-frequency training sound signal;

determine an inverted filter model characteristic; and combine the inverted filter model characteristic with the preconditioned internal speech signal to produce a preprocessed internal speech signal.

10. The device of claim 9, wherein the processor is further configured to receive, by the indirect conduction microphone, a training sound; and filter the training sound to produce a low-frequency training sound signal.

11. The device of claim 10, wherein the training sound is produced by a user of the indirect conduction microphone.

12. The device of claim 10, wherein the training sound is an internal excitation produced by the indirect conduction microphone.

13. The device of claim 9, further comprising a voice encoder configured to receive the preprocessed internal speech signal; and digitize the preprocessed internal speech signal.

14. The device of claim 9, wherein the indirect conduction microphone is an ear microphone.

15. The device of claim 9, wherein the indirect conduction microphone is a throat microphone.

16. The device of claim 9, wherein the indirect conduction microphone is a skull microphone.

* * * * *